US012215508B2

(12) United States Patent
Kolb

(10) Patent No.: US 12,215,508 B2
(45) Date of Patent: Feb. 4, 2025

(54) CLIMBING SYSTEM AND METHOD FOR OPERATING A CLIMBING SYSTEM

(71) Applicant: PERI SE, Weissenhorn (DE)

(72) Inventor: Tobias Kolb, Altenstadt (DE)

(73) Assignee: PERI SE, Weissenhorn (DE)

( * ) Notice: Subject to any disclaimer, the term of this patent is extended or adjusted under 35 U.S.C. 154(b) by 1089 days.

(21) Appl. No.: 16/969,443

(22) PCT Filed: Feb. 11, 2019

(86) PCT No.: PCT/EP2019/053301
§ 371 (c)(1),
(2) Date: Aug. 12, 2020

(87) PCT Pub. No.: WO2019/155055
PCT Pub. Date: Aug. 15, 2019

(65) Prior Publication Data

US 2021/0002909 A1 Jan. 7, 2021

(30) Foreign Application Priority Data

Feb. 12, 2018 (DE) ..... DE 102018202097.3

(51) Int. Cl.
*E04G 11/28* (2006.01)
*E04G 3/28* (2006.01)
(Continued)

(52) U.S. Cl.
CPC ..... *E04G 11/28* (2013.01); *E04G 3/28* (2013.01); *E04G 5/046* (2013.01); *E04G 17/002* (2013.01); *E04G 21/3247* (2013.01)

(58) Field of Classification Search
CPC ..... E04G 11/28; E04G 3/28; E04G 5/046; E04G 17/002; E04G 21/3247; E04G 2003/286; E04G 21/3261; E04G 5/001
See application file for complete search history.

(56) References Cited

U.S. PATENT DOCUMENTS 6,039,150 A * 3/2000 Palmer ..... E04G 21/3223 182/113
8,673,189 B2 * 3/2014 Schwoerer ..... E04G 11/28 249/20

(Continued)

FOREIGN PATENT DOCUMENTS

CN 103063123 A * 4/2013 ..... G01B 7/04
DE 102005030336 A1 1/2007

(Continued)

OTHER PUBLICATIONS

KR20110083186A_Description_translation (Year: 2011).*

(Continued)

*Primary Examiner* — Brian D Mattei
*Assistant Examiner* — Jacob G Sweeney
(74) *Attorney, Agent, or Firm* — SLEMAN & LUND LLP

(57) ABSTRACT

A climbing system, in particular a self-climbing formwork system, comprising at least one climbing rail which is guided on at least two climbing shoes, wherein the climbing shoes can be fastened on and/or in a cured concreting section, and wherein the climbing shoes are designed to guide the climbing rail and/or to hold it at least with respect to a climbing direction, and an actuator. The at least one climbing rail has at least a first and a second rail part, wherein the first and the second rail part are arranged one behind the other as viewed in the climbing direction, in that the first and the second rail part can each be guided and held by means of one of the climbing shoes, and in that the actuator is designed to selectively increase or reduce the distance between the first and the second rail part along the climbing direction.

21 Claims, 6 Drawing Sheets

(51) Int. Cl.

| | |
|---|---|
| ***E04G 5/04*** | (2006.01) |
| ***E04G 17/00*** | (2006.01) |
| ***E04G 21/32*** | (2006.01) |

(56) References Cited

U.S. PATENT DOCUMENTS

| | | | | |
|---|---|---|---|---|
| 8,708,100 | B2 * | 4/2014 | Schwoerer | E04G 11/28 182/20 |
| 2009/0041879 | A1 | 2/2009 | Baum | |

FOREIGN PATENT DOCUMENTS

| | | | | |
|---|---|---|---|---|
| DE | 102007018853 | | 10/2008 | |
| EP | 1990482 | | 11/2008 | |
| EP | 2365159 | | 9/2011 | |
| FR | 2487892 | | 2/1982 | |
| KR | 100799360 | | 1/2008 | |
| KR | 20110083186 | A * | 7/2011 | E04G 11/28 |
| KR | 101622679 | | 5/2016 | |
| KR | 20160137723 | A | 12/2016 | |
| KR | 20160148758 | | 12/2016 | |
| KR | 101793403 | | 11/2017 | |
| RU | 2477408 | | 3/2013 | |
| SU | 1530717 | | 12/1989 | |
| WO | 2007000139 | A1 | 1/2007 | |

OTHER PUBLICATIONS

CN-103063123-A_Description_translation (Year: 2013).*

Peri, "RCS Rail Climbing System", Product Brochure, Edition 04|2016; PERI GmbH Schalung Gerüst Engineering: Produktbroschüre RCS Schienenklettersystem Der universelle Kletterbaukasten für sicheres Arbeiten in großer Höhe. 2016. Weißenhorn, 2016 (DE de 04 | 5sm 792158). S. 1-80. URL: https://www.peri.de/.resources/brochures/jcr:6fbe1664-3fe4-473e-9d97-ad70ffa88ed2/RCS%20Schienenklettersystem.pdf [abgerufen am Jun. 14, 2018].—Firmenschrift.

* cited by examiner

CLIMBING SYSTEM AND METHOD FOR OPERATING A CLIMBING SYSTEM

FIELD OF THE INVENTION

The invention relates to a climbing system, in particular a self-climbing formwork system, comprising at least one climbing rail guided on at least two climbing shoes, it being possible to fasten the climbing shoes to and/or in a hardened concreting section, and the climbing shoes being designed to guide the climbing rail or to at least hold said climbing rail with respect to a climbing direction, and an actuator.

BACKGROUND OF THE INVENTION

A climbing system is known, for example, in the form of the "RCS Rail Climbing System" from Peri GmbH, Weißenhorn, Germany (http://www.peri.de/produkte/schalungssysteme/rcs-schienenklettersystem.html; retrieved on Jan. 15, 2018).

A rail-climbing system makes it possible for climbing units, which for example comprise formwork elements and/or working platforms, to climb vertically, so as to be guided by rails, along a wall surface to be constructed gradually over multiple stories.

For this purpose, the climbing unit together with one or more associated climbing rails is moved, for example hydraulically, from a lower story to another, higher story. In known systems, for this purpose, a hydraulic actuator is supported on each climbing shoe that is mounted on the wall of the lower story to be climbed, in order to slide the climbing rail upward or in the desired climbing direction.

The actuator can then be dismounted and re-mounted on a wall of a higher story (if climbing is intended to be in the upward direction), such that the climbing process can be continued. During the climbing, the climbing rails are each guided in the climbing shoes. After reaching the desired story, i.e. after a climbing process is completed, the climbing rails can be fixed in or to the climbing shoes, for example by means of a bolt, in order to prevent said rails from accidentally slipping back.

A climbing shoe of climbing formwork is known from WO 2007/000136 A1, for example.

In known climbing systems, it is, however, labor-intensive for it to only be possible for climbing to take place in a discontinuous manner; in particular, extensive manual interventions are required, for example when relocating the actuator(s). When using a plurality of climbing rails arranged in parallel, in particular when using a plurality of climbing units which are for example arranged around a building to be constructed, it is made significantly more difficult for the climbing units to be moved synchronously. As a result, hazardous zones, in particular fall areas, may arise during the climbing.

SUMMARY OF THE INVENTION

The problem addressed by the invention is to provide a climbing system and a method for operating a climbing system by means of which the climbing process is simplified.

This problem is solved by a climbing system, in particular a self-climbing formwork system, comprising at least one climbing rail guided on at least two climbing shoes, it being possible to fasten the climbing shoes on and/or in a hardened concreting section, and the climbing shoes being designed to guide the climbing rail and/or to at least hold said climbing rail with respect to a climbing direction, and an actuator, the at least one climbing rail comprising at least one first and one second rail part, wherein the first and the second rail part are arranged one behind the other when viewed in the climbing direction, wherein the first and the second rail part can each be guided and held by means of one of the climbing shoes, and wherein the actuator is designed to increase or decrease the distance between the first and the second rail part in the climbing direction as desired.

The actuator can therefore be supported on a climbing shoe by the second rail part. It can push the first rail part away from the second rail part, while the first rail part can remain in a climbing shoe.

If climbing is intended to take place upward, the actuator can be indirectly supported on a lower climbing shoe by the second, lower, rail part and can push the first, upper, rail part upward. In other words, the actuator can move the first rail part in the climbing direction.

The actuator can then reduce the distance between the first and the second rail part again. In this process, the first rail part can then be held in a climbing shoe assigned thereto, in the example an upper climbing shoe. The actuator thus then pulls the second rail part upward; the second rail part can climb in the climbing direction.

Lastly, the first rail part can be pushed further in the climbing direction again by means of the actuator and the second rail part can in turn be pulled behind. Therefore, the climbing system can climb continuously. It is no longer necessary to relocate the actuator. The manual effort for carrying out the climbing process can be considerably reduced, in particular by it no longer being necessary to mount and dismount the actuators; set-up times can be reduced.

The actuator can be arranged outside the usual working region, such that work can be carried out unimpeded on the working platform, for example. Despite the innovative climbing principle, standard components can otherwise still be used, such that the climbing system can be constructed in a particularly cost-effective manner.

During the climbing process, climbing shoes are gradually vacated counter to the climbing direction. These climbing shoes can be mounted in the climbing direction in a starting region of the first rail part, i.e., in the example, in the region of an upper end of the first rail part, such that the climbing process can be continued without interruption, even over several stories. The climbing system thus makes it possible to alternately use the climbing shoes as guides and as holders for a rail part.

The climbing process can proceed with improved safety and/or more reliably since the climbing rails can be securely held on at least one climbing shoe at any time.

Since the actuators in particular can be arranged in standardized positions (for example between the two rail parts), the climbing process can also take place synchronously over a plurality of climbing rails. Fall areas are thus prevented; fall protection in this respect can be dispensed with.

Overall, a "caterpillar-like," in particular continuous, climbing process can be produced. In comparison with known climbing systems, at least one working step in the form of relocating the actuator and/or in the form of repositioning the climbing rail is omitted.

Since the climbing rail is divided into at least two parts and is thus shorter than a one-piece climbing rail, it is also easier to transport when dismounted.

Although the climbing process usually takes place upward from the bottom of a building, it is also conceivable, for example after a building is completed, for an opposite climbing direction, in particular directed from top to bottom, to also be provided as a climbing direction.

It is conceivable for the climbing rail to comprise a leading rail part that leads in the climbing direction and a trailing rail part that trails the leading rail part in the climbing direction. In the above example, in particular, the first rail part can be assigned to the leading rail part and the second rail part can be assigned to the trailing rail part. Therefore, the leading rail part and/or the trailing rail part can be specially tailored to the respective requirements resulting from their relative position. For example, the trailing rail part may comprise a trailing working platform. The trailing working platform can be configured and/or arranged such that climbing shoes over which the climbing process has already been completed and are no longer required can be dismounted by a worker.

A particularly stable and safely guided configuration results when the climbing system is designed as a rail-guided self-climbing system.

It can also be provided that the actuator is designed as or comprises a linear drive, in particular a hydraulic or pneumatic cylinder, a spindle drive, a rack-and-pinion drive and/or a chain drive. Therefore, the actuator and the first and the second rail part can be arranged in a common longitudinal direction, in particular in the climbing direction. For example, the actuator, which is in particular designed as a linear drive, can be arranged between the first and the second rail part. A linear drive also makes it possible, in particular in one of the above-mentioned manners, to increase and/or decrease the distance between the first and the second rail part in a particularly smooth and/or continuously controllable manner.

It is particularly advantageous for the actuator to be designed to be remote-controllable or as a remote-controllable unit. Therefore, the climbing system can be controlled in a remote-controlled manner by a worker. A worker can thus also particularly easily control a plurality of similar climbing systems at the same time and/or in a time-delayed manner if required.

It is particularly advantageous that the actuator is or can be fixed to the first and/or the second rail part, preferably to the trailing rail part. For example, the actuator may be designed as a hydraulic cylinder. The piston rod of the hydraulic cylinder can then be fixed to the first rail part and the piston housing can be fixed to the second rail part, for example. Therefore, the distance between the two rail parts can be increased by extending the piston rod and can be decreased by retracting the piston rod.

It is also conceivable for the actuator to be arranged on an inner and/or outer face of the first and/or the second rail part. Therefore, a wide range of forms of rail parts and/or climbing shoes can be used for the climbing system according to the invention. For this purpose, the positioning of the actuator can preferably be selected such that the actuator can climb past the climbing shoe at any point in time or in any phase of the climbing process at a distance from said climbing shoe.

The climbing system can also be reinforced and/or stabilized when the first and the second rail part are guided relative to one another by means of a guide element. By means of the guide element, shear forces can in particular be absorbed which could otherwise act on the actuator and/or impair its function.

The guide element can be stiffened for this purpose. For example, it may be rail-shaped and/or designed as a metal sheet, in particular a profiled metal sheet, or as a tube or profiled piece having a round or angular cross section.

For an optimal connection between the guide element and the relevant rail part, the guide element can be arranged on or in the first and/or on or in the second rail part on the inside and/or the outside. It may also surround the first and/or the second rail part in part.

It may be provided that the guide element comprises a joint. Therefore, the guide element can bend, preferably in a limited manner and/or in at least one degree of freedom. As a result, the climbing system can be particularly easily adapted to climbing situations in which the system has to climb non-straight paths. For example, the climbing system can therefore also be designed to climb over wall projections or the like. The joint can in particular be detachably lockable. For example, the joint may be designed to be braced, in particular reversibly, by means of a socket pin, for example.

It may also be provided that the climbing system comprises a position-measuring apparatus for detecting the distance and/or the position of the actuator, the first and/or the second rail part. In particular, a central and/or decentralized control unit may be provided. By means of the position-measuring apparatus, the control unit can, for example, detect the relative position of the first rail part relative to the second rail part. In this way, the climbing process can be easily monitored and/or controlled.

For this purpose, the position-measuring apparatus can be integrated in the actuator, arranged thereon and/or formed thereon and/or assigned thereto. The position-measuring apparatus can thus detect the state of the actuator, for example whether the actuator is retracted or extended. It is thus made easier to detect the distance of the first rail part relative to the second rail part.

The load-bearing capacity of the climbing system can be increased when the first and the second rail part are designed as a profiled rail, in particular as a U-shaped, double U-shaped, T-shaped or H-shaped profiled rail. The profiled rail can in particular also be formed by rails connected by sleeves.

It is particularly advantageous for the climbing system to comprise an additional actuator and an additional climbing rail spaced apart from the climbing rail, the climbing system being configured to operate the actuator and the additional actuator such that they are coordinated with one another, in particular in a synchronous manner. In other words, a climbing unit, for example a formwork element and/or a working platform, can be arranged on two or more climbing rails according to the invention. For example, climbing rails according to the invention can each be arranged in the region of lateral ends of the climbing unit. By operating the actuators of the respective climbing rails in a manner coordinated with one another, the climbing unit can thus be smoothly and safely moved in the climbing direction.

In further embodiments, it is provided that the climbing system in particular comprises the climbing unit, a working platform, a trailing platform and/or a protective grating. For example, the climbing system may comprise both a working platform and a trailing platform. Therefore, work to construct a new concreting section and finishing work, for example on a previously constructed concreting section, can take place at the same time.

When the protective grating is formed in at least two parts, a first protective-grating part being indirectly or directly arranged on the first or on the second rail part and a second protective-grating part being indirectly or directly arranged on the other of the two rail parts, the climbing process can take place without any disruption, even if the protective grating extends over multiple levels or stories.

Furthermore, the context of the invention covers a method for operating a climbing system according to the invention, wherein the distance between the first and the second rail part is first increased and then decreased. This utilizes the fact that the climbing system can be supported on the climbing shoe assigned to the second rail part when increasing the distance. Therefore, the first rail part can be moved in the climbing direction when increasing the distance. The first rail part can then be held on the climbing shoe assigned thereto while the distance is decreased. By decreasing the distance, the second rail part can then be pulled behind; therefore, the first and the second rail part and thus also the climbing unit can be moved in the climbing direction.

In particular, the method may be configured to comprise the following steps:

- sliding the first rail part into a leading position by means of the actuator,
- fixing the first rail part in the leading position, preferably in a first climbing shoe when viewed in the climbing direction,
- detaching the first rail part from the second climbing shoe, the second climbing shoe being arranged behind the first climbing shoe when viewed in the climbing direction, and
- pulling the second rail part in the climbing direction by means of the actuator.

In the process, the first rail part may preferably form the leading rail part and the second rail part may preferably form the trailing rail part.

Before step i), the second rail part can be fixed in the climbing shoe assigned thereto at least in the climbing direction and/or can be held by said climbing shoe during the sliding. The first rail part can then be directly and/or indirectly supported on the second rail part in order to slide into the leading position.

Overall, the climbing rail and the climbing unit arranged thereon can thus be moved in the climbing direction similarly to the forward movement of a caterpillar. This movement can take place continuously. In particular, regular dismounting and mounting of the actuator in order to cover larger distances, in particular distances that exceed the entire length of the two rail parts, in particular considerably, can be dispensed with.

It may be provided that a working platform, a trailing platform and/or a protective grating are moved together with the first and/or the second rail part. In particular, these elements can be mounted on the existing climbing rails before the climbing.

It is also conceivable to mount additional elements, components or the like on at least one of the climbing rails and/or the climbing unit, such that these elements can also be moved in the climbing direction as well during the climbing. Therefore, transport systems, for example crane systems, which are otherwise standard can be dispensed with at least in part.

It is conceivable in particular that the climbing system comprises a control unit. The control unit may comprise a computer unit. The control unit may be designed to be remote-controllable. It may in particular be designed to control the actuator. Therefore, by means of the control unit, the method according to the invention for climbing can be implemented automatically.

Further features and advantages of the invention will become apparent from the following detailed description of an embodiment of the invention with reference to the figures of the drawings, which show details essential to the invention, and from the claims.

The individual features can be implemented in variants of the invention either individually or in any combination.

In the schematic drawings, embodiments of the invention are shown and are explained in greater detail in the following description.

DETAILED DESCRIPTION

Figures 1, 2, 3, 4:
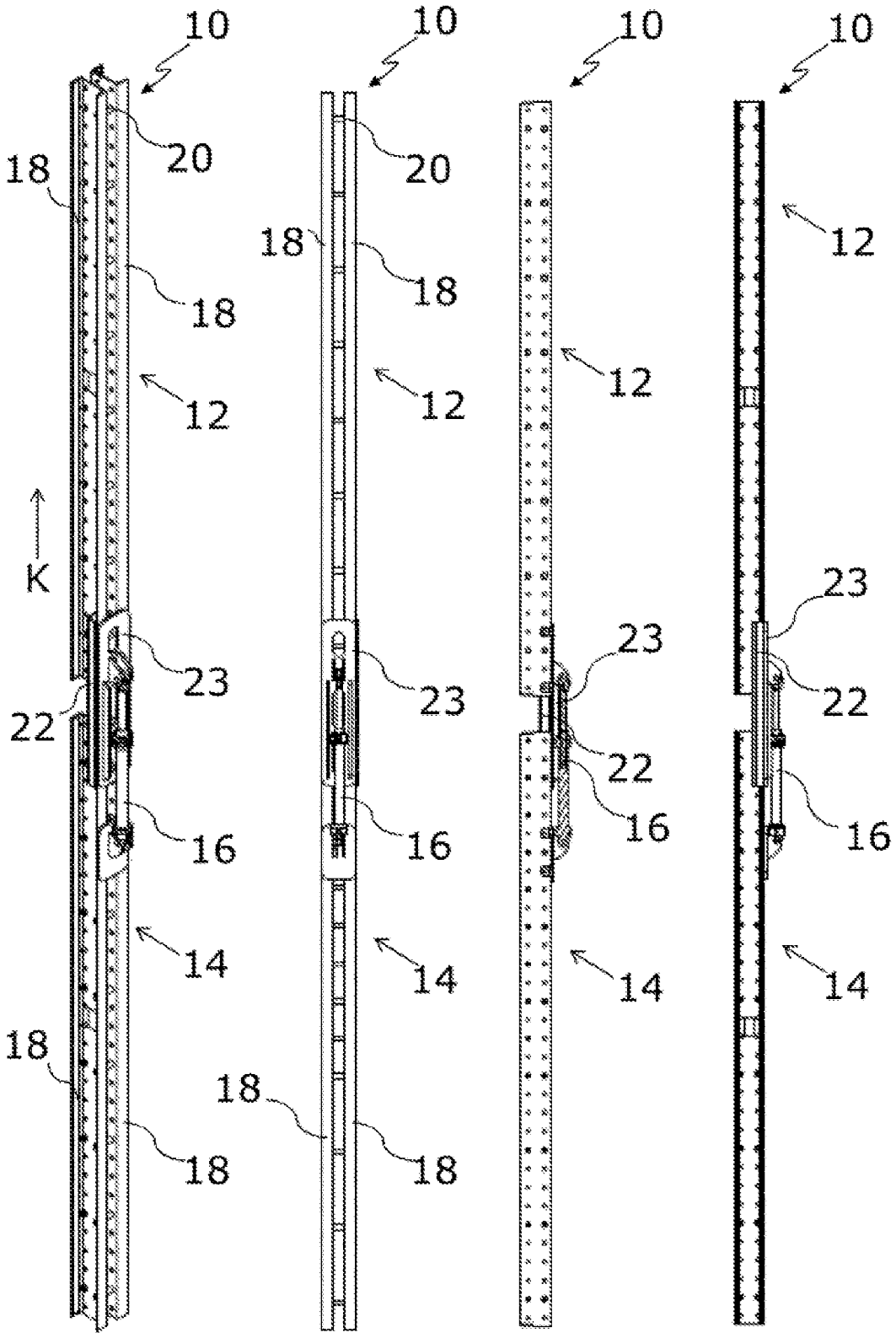
FIGS. 1 to 4 are a perspective view, a plan view, a sectional view and a side view, respectively, of a climbing rail comprising an actuator.

For the sake of improved comprehension of the invention, identical reference signs are used in the following for identical or corresponding elements. Likewise, to describe the method according to the invention, the reference signs in FIGS. 1 to 8 are used to denote elements of the climbing system used for the method.

FIGS. 1 to 4 show a first embodiment of a climbing rail 10. The climbing rail 10 comprises a first rail part 12 and a second rail part 14. The two rail parts 12, 14 are interconnected by an actuator 16 that is arranged on an outer face of the climbing rail 10 and is designed as a hydraulic drive.

It can be seen in particular from the perspective view of the climbing rail 10 according to FIG. 1 and from the plan view of the climbing system 10 according to FIG. 2 that the rail parts 12, 14 are each formed by two profiled elements 18. In this embodiment, the profiled elements 18 have a U-shaped cross section and are formed by steel rails. Bolts 20, of which one bolt 20 is provided with a reference sign by way of example in each of FIGS. 1 and 2 and which are arranged in rows at regular intervals, each interconnect two profiled elements 18 to form the first rail part 12 and the second rail part 14.

When viewed in a climbing direction K, the first rail part 12 and the second rail part 14 are arranged in succession. The first rail part 12 thus forms a leading rail and the second rail part 14 forms a trailing rail.

As will be explained in greater detail below, the two rail parts 12, 14 can be guided along the profiled elements 18 and also held thereon on climbing shoes which are described in greater detail below.

FIG. 3 is a lateral cross section through the climbing rail 10 and FIG. 4 is a side view of the climbing rail 10. It can be seen that the actuator 16 is fixed to the first rail part 12 at one end and to the second rail part 14 at the other end, and is thus arranged thereon.

Furthermore, the first and the second rail part 12, 14 are oriented relative to one another by means of a guide element 22. In particular, the guide element 22 bridges any space between the two rail parts 12, 14. To do this, it is fixed to the first rail part 12 and is movably arranged on the second rail part 14 in the longitudinal direction of the rail part 14.

As can also be seen from FIGS. 1 and 2, the guide element 22 comprises an outer surface 23. Therefore, the guide element 22 is arranged both inside and outside the climbing rail 10, in particular so as to surround said rail at least in portions.

The guide element 22 and in particular the outer face 23 thereof are elongate. The length is selected such that the guide element 22 spans a space formed between the first and second rail part 12, 14 at any time during a climbing process.

Figure 5:
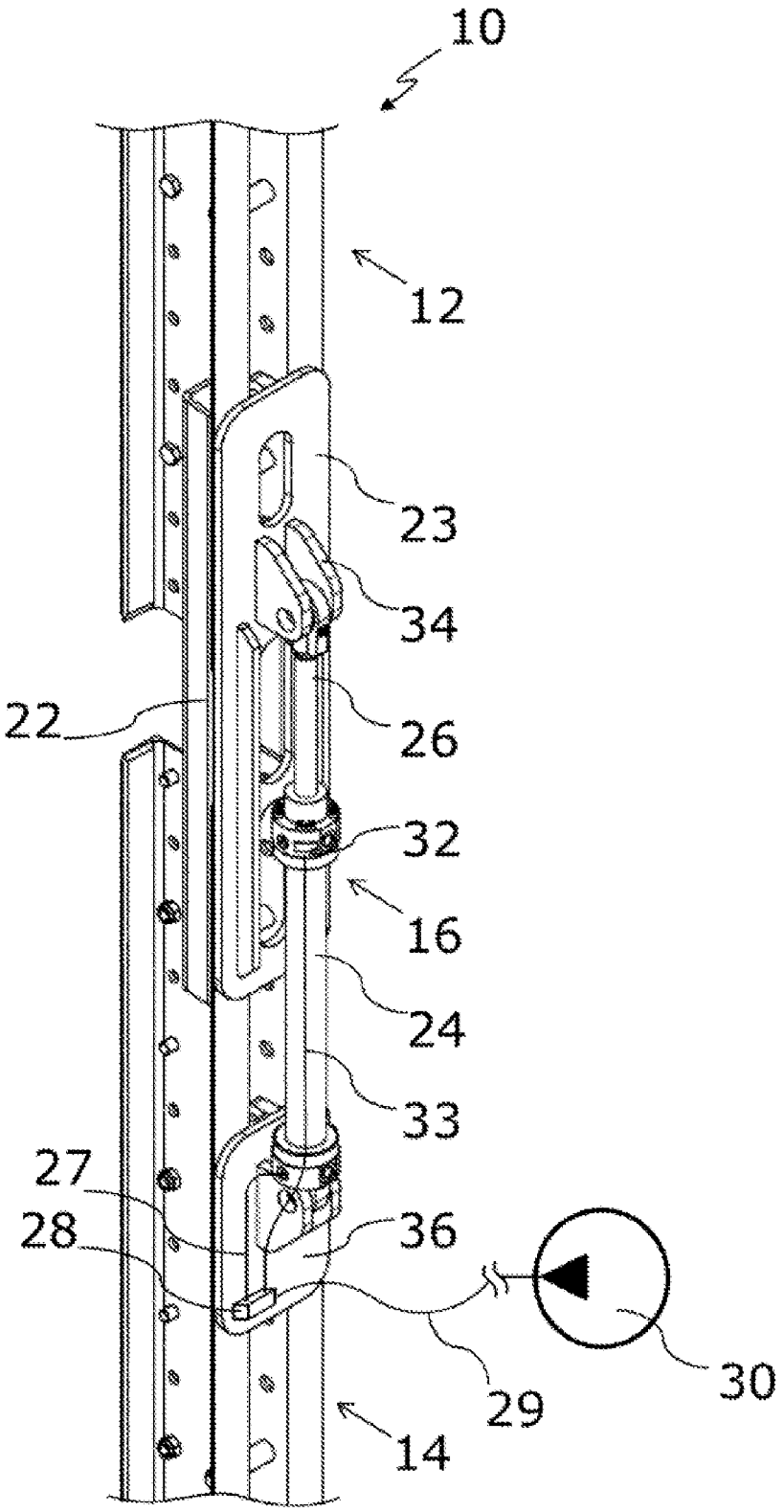
FIG. 5 is an enlarged view of the actuator of the climbing rail from FIGS. 1 to 4.

FIG. 5 then shows an enlarged detail of the previously described climbing rail 10. The actuator 16 can be seen in particular. The actuator 16 comprises a piston 24, which drives a piston rod 26. It can be seen that the actuator 16 is connected at one end, namely the piston-rod side, to the first rail part 12 by the outer face 23. In particular, it is articulated by a joint 34 to the outer face 23 of the guide element 22 and thus also to the first rail part 12. The joint 34 has limited deflection. Therefore, the first rail part 12 can be pivoted relative to the second rail part 14 at least in a limited manner. Therefore, projections on a wall to be climbed can also be negotiated by the climbing rail 10, for example.

At the other end, the actuator 16 is connected to the second rail part 14 by a contact surface 36.

The piston 24 is designed such that it can be hydraulically operated. For this purpose, the piston 24 can be supplied with a hydraulic liquid in a controlled manner via a hydraulic line 27. The hydraulic line 27 is connected to a control unit 28 arranged on the actuator 16. This is in turn connected to a schematically shown hydraulic-pressure supply 30, for example a hydraulic pump comprising a connected hydraulic-liquid accumulator, via a supply line 29. In this process, the hydraulic-pressure supply 30 serves to provide pressurized hydraulic liquid required for actuating the actuator 16.

A position-measuring apparatus 32 is arranged on the actuator 16, in particular on the piston 24. The position-measuring apparatus is connected to the control unit 28 in terms of signals by a signal line 33.

The position-measuring apparatus 32 detects the extension state of the actuator 16 on the basis of the state of the piston rod 26, in particular on the basis of the length of how far said rod is extended or retracted. The measured extension state serves as a measure of the distance of the first rail part 12 from the second rail part 14. The extension state is transmitted to the control unit 28 via the signal line 33.

The control unit 28 is configured to control the supply of hydraulic liquid to the piston 24 via the hydraulic line 27. By supplying the piston 24 or piston rod 26 in a controlled manner, it is thus possible to space the first rail part 12 apart from the second rail part 14 (greater supply) or to bring said two rail parts toward one another (lower supply); the climbing rail 10 is thus movable or is thus moved.

In the process, the control unit 28 monitors the movement on the basis of the extension or retraction state of the piston rod 26, which is determined by the position-measuring apparatus 32, in the piston 24.

The control unit 28 comprises an integrated radio receiver for the remote control of the control unit 28. Therefore, the actuator 16 is also designed to be remote-controllable as a whole. For example, a worker can thus remotely start or stop a climbing movement by remote-controlling the actuator 16.

Figure 6:
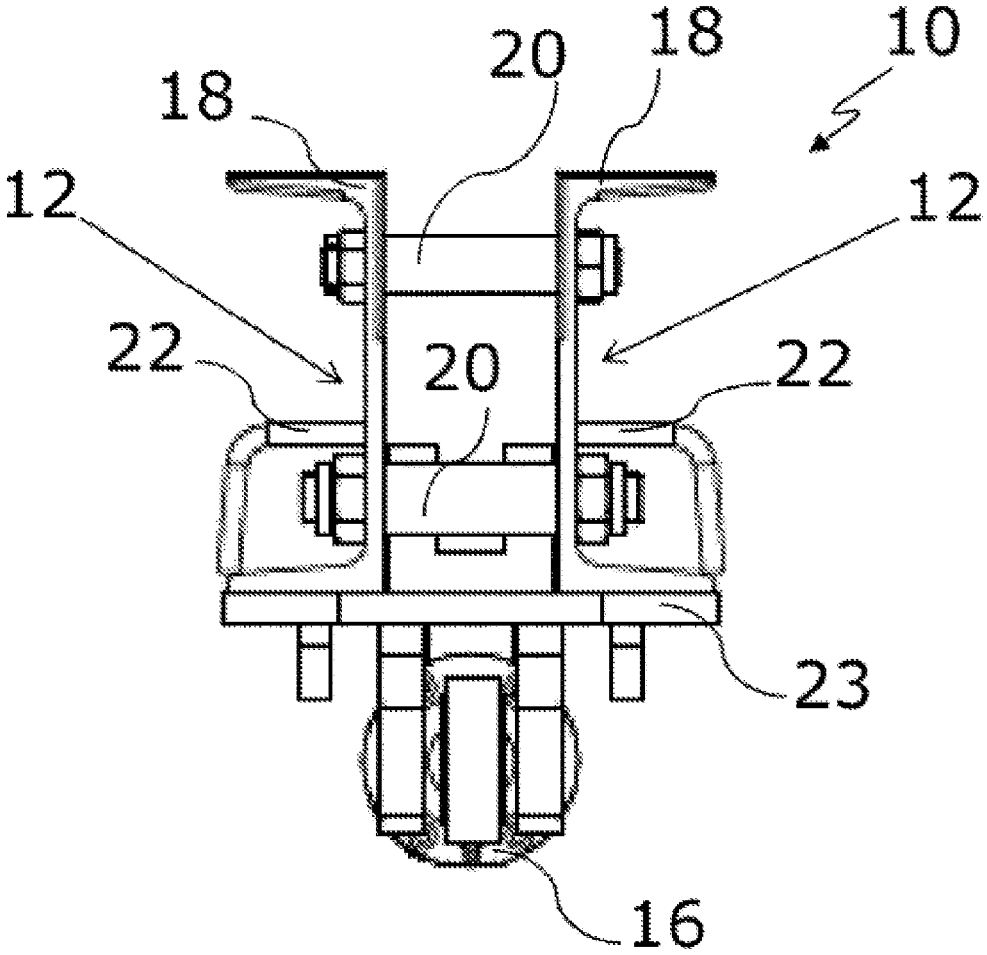
FIG. 6 is a view from above of the climbing rail from FIGS. 1 to 4.

As can be seen from FIG. 6, which is a plan view of the first rail part 12 of the climbing rail 10, the guide element 22 is designed in multiple parts and in particular symmetrically; it is also fixed to the profiled elements 18 of the first rail part 12, which are positioned on either side. Each individual element of the guide element 22 arranged on the inside of the profiled elements 18 is formed as a substantially right-angled bracket element. Together with its outer face 23, the guide element also at least surrounds the bolts 20 which are each located in the region of the guide element 22 and in the vicinity of the actuator 16.

It should be noted that the components 27, 28, 29, 30 and 33 have not been shown in FIGS. 1 and 4 or in FIG. 6 solely for the purposes of presentation.

Figure 7:
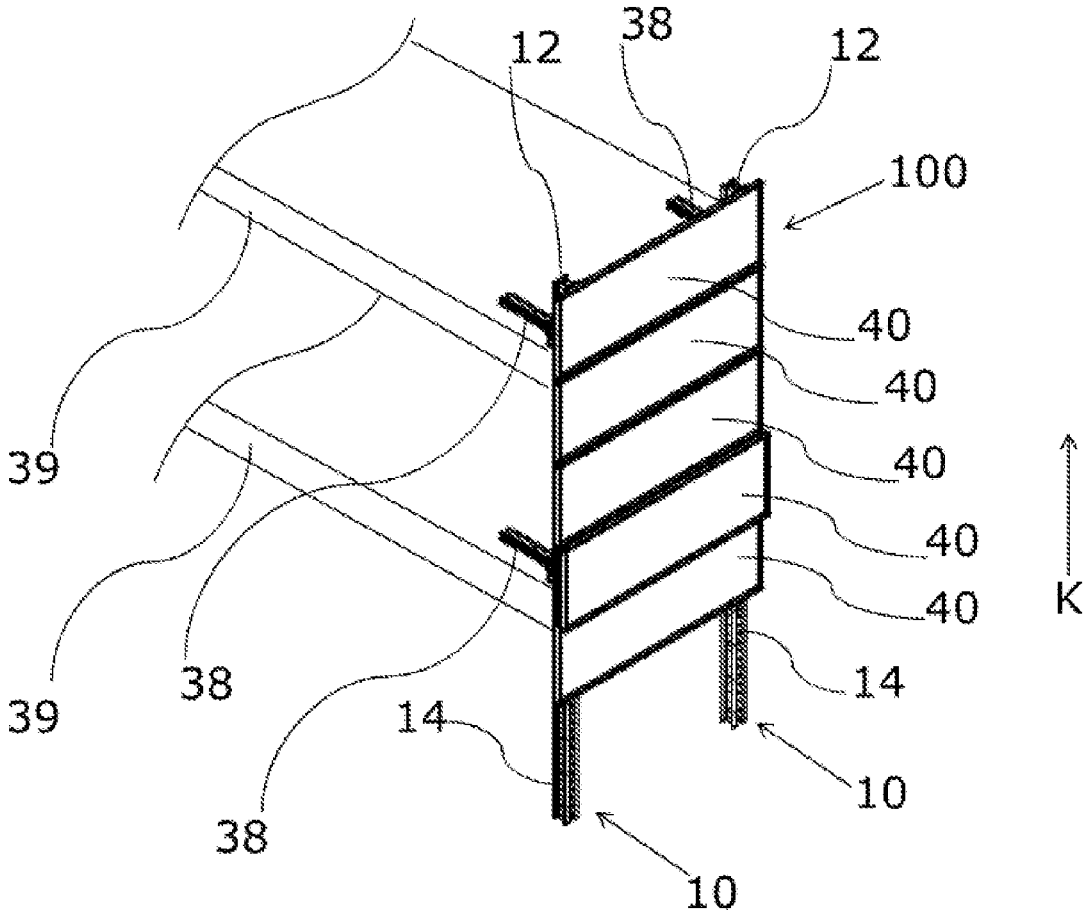
FIG. 7 is a perspective view of a climbing system comprising a plurality of covers.

FIG. 7 shows a climbing system 100 according to the invention. The climbing system 100 comprises two climbing rails 10 that are arranged in parallel with one another and each correspond to the previously described climbing rails 10 according to FIGS. 1 to 6.

Each of the rail parts 12, 14 of the climbing rails 10 is guided and/or held on one climbing shoe 38. The climbing shoes 38 may for example be substantially in the form of climbing shoes known from WO 2007/000136 A1, mentioned at the outset, in particular comprising a blocking device for permanently blocking the climbing rail 10 or the rail parts 12, 14. In addition, the climbing shoes 38 comprise a latching device, by means of which the climbing rails 10 can each be guided in parallel with a relevant climbing direction K but can only be moved upward or downward, in the climbing direction, such that when a rail part is loaded and/or moved counter to the climbing direction, it automatically latches to the relevant climbing shoe 38 and is held there.

For the purposes of presentation, only three of the four climbing shoes 38 are shown. The climbing shoes 38 are fastened to schematically shown floor slabs 39, which are formed as hardened concreting sections. In the figure, ceiling climbing shoes are shown. The climbing system can, however, also be operated with wall climbing shoes or with a mixture of ceiling and wall climbing shoes.

Yet more climbing shoes can also be mounted above and/or below the climbing rails 10, for example on further floor slabs and/or story-level walls.

A plurality of planar covers 40 are located on the outside of the climbing rails 10. They form a climbing unit of the climbing system 100.

Here, the cover 40 which is arranged in the region of the actuators (not shown in FIG. 7) is arranged so as to be additionally spaced apart from the climbing rails 10.

The covers 40 act, for example, as protection against dirt and/or falling parts due to work being carried out behind the climbing system 100 in a building to be constructed.

Figure 8:
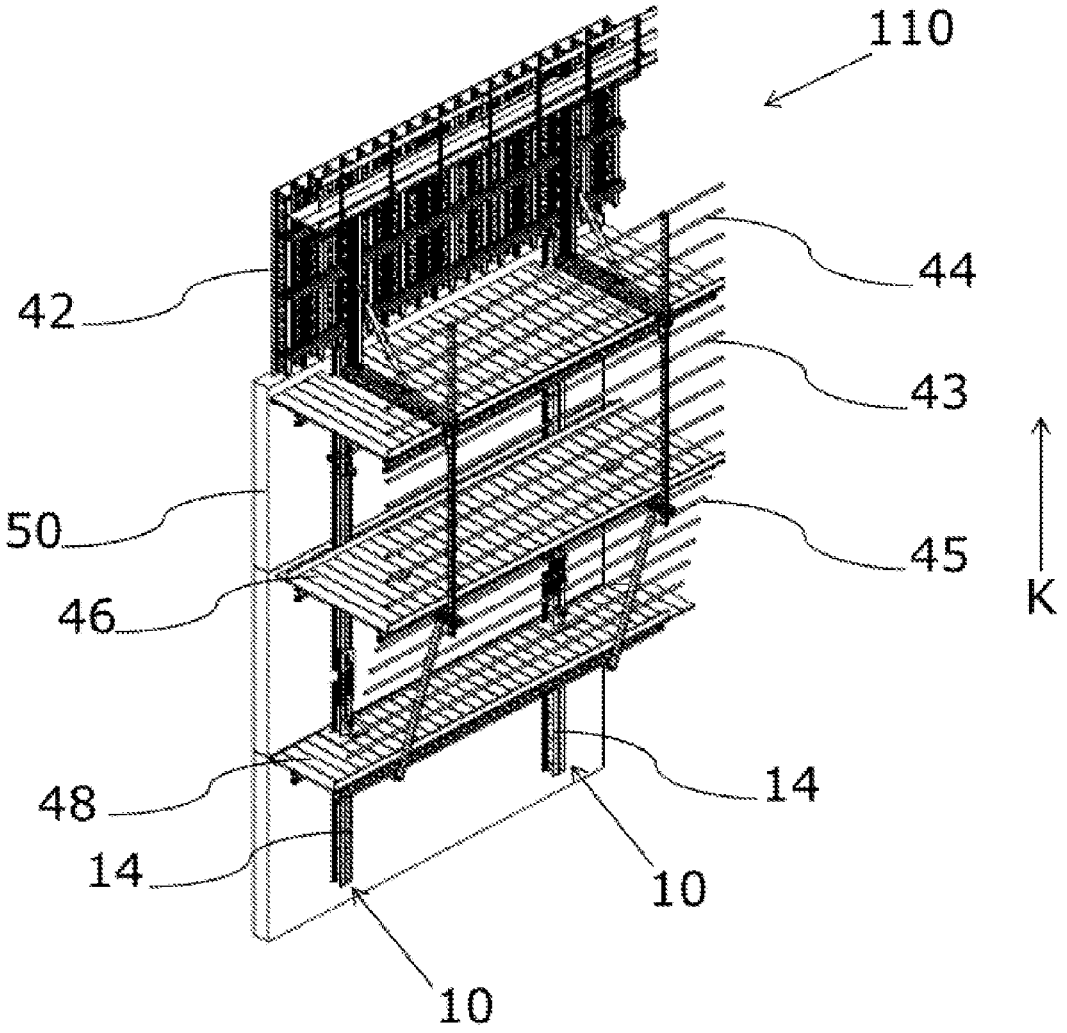
FIG. 8 is a perspective view of another climbing system comprising a formwork element, a working platform and a trailing platform, as well as a protective grating.

FIG. 8 shows another climbing system 110 according to the invention. The climbing system 110 in turn comprises two climbing rails 10 that are arranged in parallel with one another. These climbing rails 10 also correspond to the climbing rail from FIGS. 1 to 6.

It can be seen that a movable formwork element 42, a protective grating 44 extending over multiple stories to be constructed as well as a working platform 46 and a trailing platform 48 are arranged on the climbing rails 10, which extend in parallel. In this case, the trailing platform 48 is in particular arranged on the second rail parts 14 of the climbing system 10. These elements 42, 44, 46 and 48 thus form a climbing unit of the climbing system 110.

The protective grating 44 is formed in multiple parts such that varying distances between the working platform 46 and the trailing platform 48, for example, can be compensated for. To do this, a first protective-grating part 43 of the protective grating 44 is indirectly arranged on the first rail parts 12 and a second protective-grating part 45 is indirectly arranged on the second rail parts 14.

As can be seen from FIG. 8, the climbing rails 10 are guided and/or held on a hardened concreting section 50 by means of climbing shoes (which are not shown in greater detail in FIG. 8, but substantially correspond to the climbing shoes 38 in FIG. 7). In this case, these are wall climbing shoes, which are not fastened to the surface of a floor slab, but to a vertically oriented wall. The climbing system 110 can climb along the concreting section 50. In particular, it can climb in a climbing direction K, in this case in the vertical direction.

FIG. 9 to FIG. 12 are side views of the climbing system 100 from FIG. 7 in different climbing stages, with the aid of which a variant of the method according to the invention is set out in the following by way of example.

It can be seen that the first and the second rail parts 12, 14 are arranged on their cover plates 40. To simplify the views, only a few of the cover plates 40 are shown. In turn, the rail parts 12, 14 are each held or guided on climbing shoes 38 assigned thereto.

Figures 9, 10, 11, 12:
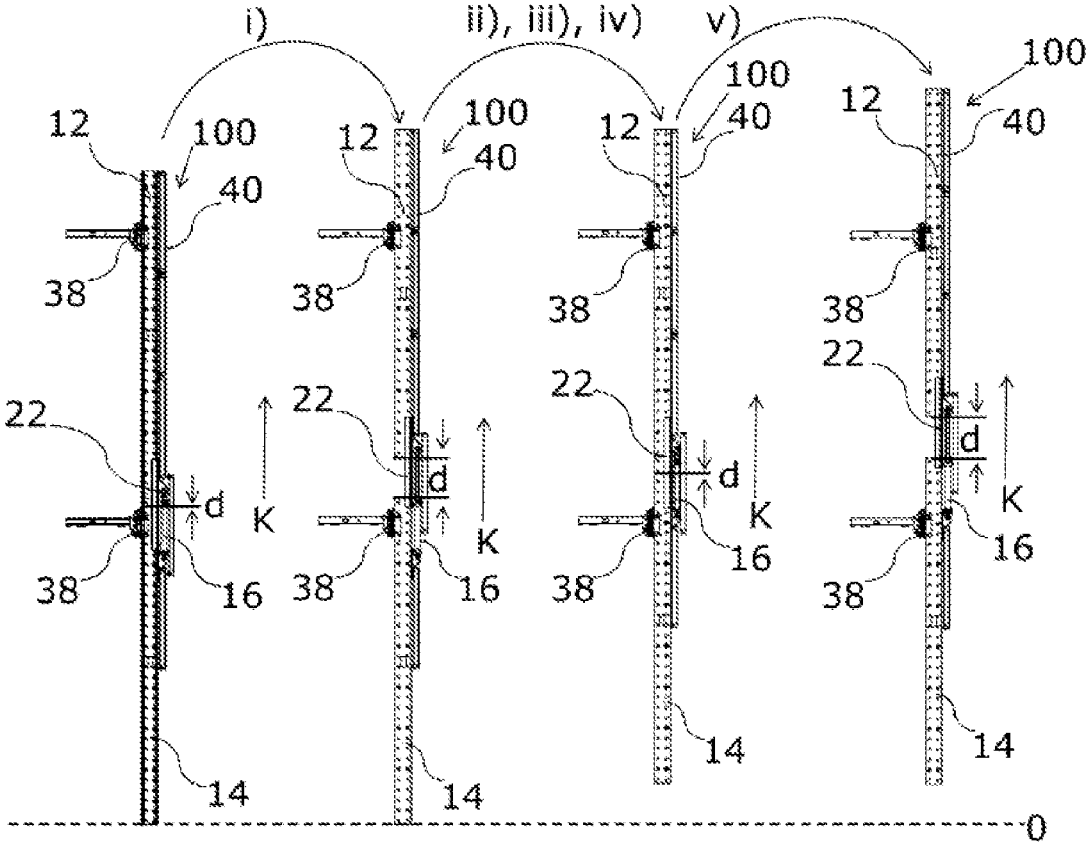
FIGS. 9 to 12 are schematic side views of the climbing system from FIG. 7 in different stages of the method according to the invention.

According to the method according to the invention, FIG. 9 shows an initial stage, in which the second rail parts 14 (only one rail part 14 is shown) are held in climbing shoes 38 assigned thereto. The first rail parts 12 are brought toward the second rail parts 14 and are no distance d therefrom or are only a slight distance therefrom. For this purpose, the actuator 16 is retracted down to its minimum possible length.

The second rail parts 14 are held in second climbing shoes 38 assigned thereto, in particular by means of the latching devices thereof. By contrast, the first rail parts 12 are merely guided in parallel with the climbing direction K in first climbing shoes 38 assigned thereto.

As shown in FIGS. 9 to 12, the second climbing shoes 38, i.e. the climbing shoes 38 assigned to the second rail parts 14, are arranged behind the first climbing shoes 38, i.e. the climbing shoes 38 assigned to the first rail parts 12, when viewed in the climbing direction K.

If the actuators 16 (only one actuator 16 is shown) are then actuated, and in particular extended, for a first method step i), the first rail parts 12 are slid into a leading position by means of the actuators 16. To do this, the respective actuators 16 of the climbing rails 10 (FIG. 7) arranged in parallel with one another are controlled so as to be coordinated with one another, in particular synchronously, by means of synchronous remote control of the respective control units 28 (FIG. 5), such that the rail parts 12 are each moved at the same speed.

Since the second rail parts 14 are each held in the second climbing shoes 38 assigned thereto, the first rail parts 12 are thus each moved in the climbing direction K so as to be coordinated with one another, in particular synchronously, and are guided by the first climbing shoes 38 assigned thereto. The distance d between the ends of the first rail parts 12 and the ends of the respective second rail parts 14 increases up to a definable maximum, which can for example be defined by the maximum extendable length of the piston rod 26 (FIG. 5). The definable maximum of the distance d may for example be between 0.5 and 2.5 m. This results in the state shown in FIG. 10, with rail parts 12, 14 spaced apart from one another.

In a subsequent method step ii), the first rail parts 12 are then fixed in the leading position in the first climbing shoes 38 assigned thereto. Depending on the configuration of the climbing shoes 38, this can take place by latching bolts 20 (FIG. 2) into the assigned, first climbing shoes 38.

In a further method step iii), the second rail parts 14 are then detached from the second climbing shoes 38 assigned thereto.

According to a method step iv), the second rail parts 14 are then pulled in the climbing direction K by means of the actuators 16. It is sufficient here for the actuators 16 to be shortened further, and in particular they are brought together again down to their minimum length. The distance d is thus then reduced to a minimum again. This results in the state shown in FIG. 11.

It can be seen on the basis of a zero line 0 that the climbing system 100 has already climbed further in the climbing direction K, in particular corresponding to or substantially corresponding to the definable maximum for the distance d, compared with the states in FIG. 9 and FIG. 10.

In a variant of the method, it is provided that climbing shoes 38 arranged at regular intervals over the entire path to be climbed are mounted on concreting sections. In this variant, the entire path can thus be climbed without any additional work being required.

In a preferred variant of the method, however, it is provided that, as part of method step iv), during or after a second climbing rail 38 leaving an assigned, second climbing shoe 38, this climbing shoe 38, which is now no longer required for the climbing, is dismounted and, when viewed in the climbing direction K, is mounted again in front of the first rail part 12, in particular is fixed in a hardened concreting section. In this variant, paths of any length can thus also be climbed using a limited number of climbing shoes 38.

According to a subsequent, optional method step v), the method steps i)-iv) can then be repeated in order to climb longer distances, with the climbing system 100 accordingly climbing further after each passage. For this purpose, FIG. 12 shows, by way of example, a state after repeating the method until method step i) is complete.

In a variant of the method, it is provided that, instead of arranging at least one of the covers 40 as a climbing unit, a working platform, a trailing platform and/or a protective grating are arranged on the first and/or the second rail parts 12, 14. If method steps i) to iv) or i) to v) are then carried out, a climbing unit designed in this way can thus also climb in the climbing direction according to the method. If a trailing platform is provided, in particular, climbing shoes 38 that are no longer required can be dismounted from the trailing platform.

Climbing in an upward direction has been described up to now in particular. Climbing in the opposite climbing direction, in particular downward, can be carried out in a completely analogous manner to method steps i) to iv) or v); to reverse the climbing direction, it is merely necessary to swap or reverse the sequence of holding and guiding as well as of fixing and detaching the rail parts 12, 14 to and from the climbing shoes 38.

After the climbing process is complete, i.e. when a desired end position is reached, in another method variant, at least one, preferably all, rail parts 12, 14 are also additionally fixed to the climbing shoes 38 by means of socket pins, for example; this results in a particularly safe working position of the climbing system 100.

The invention claimed is:

1. A climbing system, comprising:

at least one climbing rail guided on at least two climbing shoes, the climbing shoes capable of being fastened to and/or in a hardened concreting section, and the climbing shoes being configured to guide the climbing rail and to at least hold said climbing rail with respect to a climbing direction, and an actuator, wherein the at least one climbing rail comprises at least one first and one second rail part, the first and the second rail part being arranged one behind the other when viewed in the climbing direction, in that the first and the second rail part can each be guided and held by means of one of the climbing shoes, and in that the actuator is configured to increase the distance between the first and the second rail part in the climbing direction in order to move the first rail part while being supported via the second rail part at the climbing shoe away from the second rail part, or decrease the distance to climb the second rail part along the climbing direction, when the first rail part is held in its associated climbing shoe.

2. The climbing system according to claim 1, wherein the climbing rail comprises a leading rail part in the form of the first rail part that leads in the climbing direction and a trailing rail part in the form of the second rail part that trails the leading rail part in the climbing direction.

3. The climbing system according to claim 1, wherein the climbing system is configured as a rail-guided self-climbing system.

4. The climbing system according to claim 1, wherein the actuator is designed as or comprises at least one of: a hydraulic or pneumatic cylinder, a spindle drive, a rack-and-pinion drive and/or a chain drive.

5. The climbing system according to claim 1, wherein the actuator is designed to be remote-controllable or as a remote-controllable unit.

6. The climbing system according to claim 1, wherein the actuator is or can be fixed to the trailing rail part.

7. The climbing system according to claim 1, wherein the actuator is arranged on an inner and/or outer face of the first and/or the second rail part.

8. The climbing system according to claim 1, wherein the first and the second rail part are guided relative to one another by means of a guide element.

9. The climbing system according to claim 8, wherein the guide element is rail-shaped and/or is designed as a profiled metal sheet, or as a tube or profiled piece having a round or angular cross section.

10. The climbing system according to claim 8, wherein the guide element is arranged on or in the first and/or on or in the second rail part on the inside and/or the outside.

11. The climbing system according to claim 8, wherein the guide element surrounds the first and/or the second rail part in part.

12. The climbing system according to claim 8, wherein the guide element comprises a joint.

13. The climbing system according to claim 1, wherein the climbing system comprises a position-measuring apparatus for detecting the distance and/or the position of the actuator, the first and/or the second rail part.

14. The climbing system according to claim 13, wherein the position-measuring apparatus is integrated in the actuator, arranged thereon and/or formed thereon and/or assigned thereto.

15. The climbing system according to claim 1, wherein the first and the second rail part are designed as a profiled rail, comprising one of: a U-shaped, double U-shaped, T-shaped, or H-shaped profiled rail.

16. The climbing system according to claim 1, wherein the climbing system comprises an additional actuator and an additional climbing rail spaced apart from the climbing rail, the climbing system being configured to operate the actuator and the additional actuator such that they are coordinated with one another in a synchronous manner.

17. The climbing system according to claim 1, wherein the climbing system comprises a working platform, a trailing platform and/or a protective grating.

18. The climbing system according to claim 17, wherein the protective grating is formed in at least two parts, a first protective-grating part being indirectly or directly arranged on the first or on the second rail part and a second protective-grating part being indirectly or directly arranged on the other of the two rail parts.

19. A method for operating a climbing system according to claim 1, wherein the distance between the first and the second rail part is first increased and then decreased.

20. The method according to claim 19, comprising the steps of:

sliding the first rail part into a leading position by means of the actuator, fixing the first rail part in the leading position, in a first climbing shoe when viewed in the climbing direction, detaching the first rail part from a second climbing shoe, the second climbing shoe being arranged behind the first climbing shoe when viewed in the climbing direction, and pulling the second rail part in the climbing direction by means of the actuator.

21. The method according to claim 19, wherein a working platform, a trailing platform and/or a protective grating are moved together with the first and/or the second rail part.

* * * * *